United States Patent [19]

Quinif

[11] 4,386,482

[45] Jun. 7, 1983

[54] WOOD DOOR WITH MOLDING STRIPS FORMING ANNULAR SEAL AROUND THE PERIPHERY OF THE DOOR TO PREVENT DELAMINATION

[75] Inventor: Edward G. Quinif, Phoenix, Ariz.

[73] Assignee: Walled Lake Door Co., Phoenix, Ariz.

[21] Appl. No.: 195,567

[22] Filed: Oct. 9, 1980

[51] Int. Cl.[3] ..... E06B 7/16

[52] U.S. Cl. ..... 49/488; 49/489; 52/822

[58] Field of Search ..... 49/488, 489; 52/309.9, 52/809, 829, 822, 830

[56] References Cited

U.S. PATENT DOCUMENTS

| | | | |
|---|---|---|---|
| 3,153,817 | 10/1964 | Pease, Jr. | 52/309.9 X |
| 3,521,404 | 7/1970 | Hager et al. | 49/488 X |
| 3,750,333 | 8/1973 | Vance | 49/488 X |
| 3,786,609 | 1/1974 | Difazio | 52/309.9 X |

FOREIGN PATENT DOCUMENTS

| | | | |
|---|---|---|---|
| 205701 | 10/1959 | Austria | 52/822 |
| 2405351 | 5/1979 | Fed. Rep. of Germany | 52/809 |

*Primary Examiner*—Kenneth Downey

*Attorney, Agent, or Firm*—Cullen, Sloman, Cantor, Grauer, Scott & Rutherford

[57] ABSTRACT

An exterior door comprises a frame having a pair of vertical stiles joined by horizontal rails. The outer surface of each of the stiles and rails is provided with a groove extending the full length thereof. The frame has a core. A pair of exterior panels are adhesively secured to the faces of the frame, with the upper, lower and side edges of the panels each being provided with a bevel surface having a predetermined angle. A closure molding is provided for each of the outer surfaces of the rails and stiles forming the frame. Each molding in its free state has a generally elongated rigid strip having a slightly curved web and an elongated ledge on the inner surface of the web which is perpendicular thereto. The web's outer edges are inclined, with the inner inclined surfaces thereon being on an angle equal to the angle of the bevel surfaces. The molding strips flatten out when applied to the frame, with the ledges fitting tightly into the grooves. With such a construction the inclined surfaces of the edges of the webs abut the bevel surfaces of the panels to provide at each side of the frame an inwardly directed positive force around the entire periphery thereof which opposes delamination of the panels from the frame.

1 Claim, 5 Drawing Figures

WOOD DOOR WITH MOLDING STRIPS FORMING ANNULAR SEAL AROUND THE PERIPHERY OF THE DOOR TO PREVENT DELAMINATION

BACKGROUND OF THE PRESENT INVENTION

A. Field of the Invention

This invention relates to door constructions and more particularly to a protective closure molding or strip around the periphery of the door for preventing weather damage to the door caused by moisture entering between the door panels and the frame thereby causing delaminations of the panels from the frame.

B. Description of the Prior Art

In the past, it has been customary with doors to use weather stripping on the upper and/or lower edges of the doors or to provide a protective door edge along the vertical edges of the door. Nevertheless, in such constructions, it was still possible for moisture to get between the panels and the frame of the door thus causing delamination. As a result the panels would separate from the frame.

A search of the prior art indicated the following U.S. Pat. Nos.: Golden, 686,051, (1901); Zahner, 1,554,774, (1925); Shadford, 2,089,669, (1937); Olsson, 2,607,960, (1952); Torrence, 2,705,820, (1955); Olton, 3,271,919, (1966); King, 3,333,385, (1967); Crane et al., 3,363,390, (1968); Starcevic, 3,386,209, (1968); Multer, 3,448,543, (1969); Hawes et al., 3,760,544, (1973); Difazio, 3,786,609, (1974); Wright, 4,001,974, (1977); and Bursk, 4,034,511, (1977).

SUMMARY OF THE INVENTION

It is a feature of the present invention to provide an exterior wood door, preferably a solid core door, which has an edge molding or strips forming an annular seal around the entire periphery of the frame of the door. The outer panels of the door are provided with bevel surfaces around the periphery thereof. The edge molding strips each have a pair of inclined surfaces which conform to the corresponding bevel surfaces provided on the panels to thereby provide at each side of the frame an inwardly directed positive force around the entire periphery thereof which opposes delamination of the panels from the frame.

Another feature of the present invention is to provide an exterior door in which in the event moisture should enter the door between the panels and the frame thus destroying or breaking down the adhesive connection therebetween, the force generated by the edge moldings or strips will still provide in an inwardly directed positive force around the entire periphery of the frame opposing separation of the panels from the frame.

A further feature of the present invention is to provide a wood door of the aforementioned type wherein each closure molding strip when in an unstressed or free state is provided with a crown or a slight curve which is removed when the molding strip is applied to the door frame.

A still further feature of the present invention is to provide a door of the aforementioned type wherein the molding strips provided on the top wall and on both of the stiles are each of identical construction and cross-section, with the molding strip secured to the bottom rail being provided with the same web and ledge as the other strips and is also provided with a pair of inwardly turned retaining flanges which receive the edges of a removable plate carrying a pair of compressible tubular elements adapted for sealing engagement with a cooperating door sill.

Another feature of the present invention is to provide a wood door of the aforementioned type wherein each closure molding strip is formed from a generally rigid plastic material such as polyvinyl chloride.

Another feature of the present invention is to provide a wood door of the aforementioned type wherein the angle of each of the bevel and inclined surfaces is 45°.

DESCRIPTION OF THE PREFERRED EMBODIMENT

Figure 1:
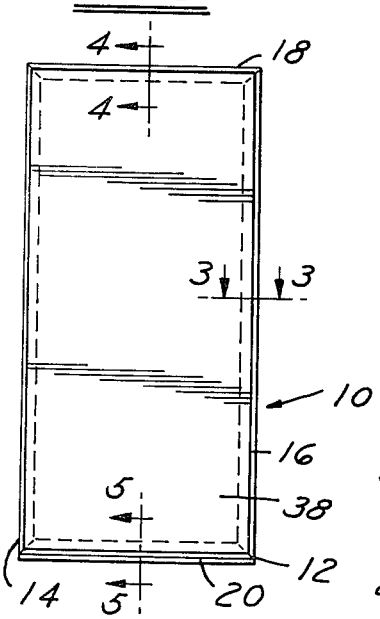
FIG. 1 is an elevation showing a door constructed according to the present invention.
Figure 3:
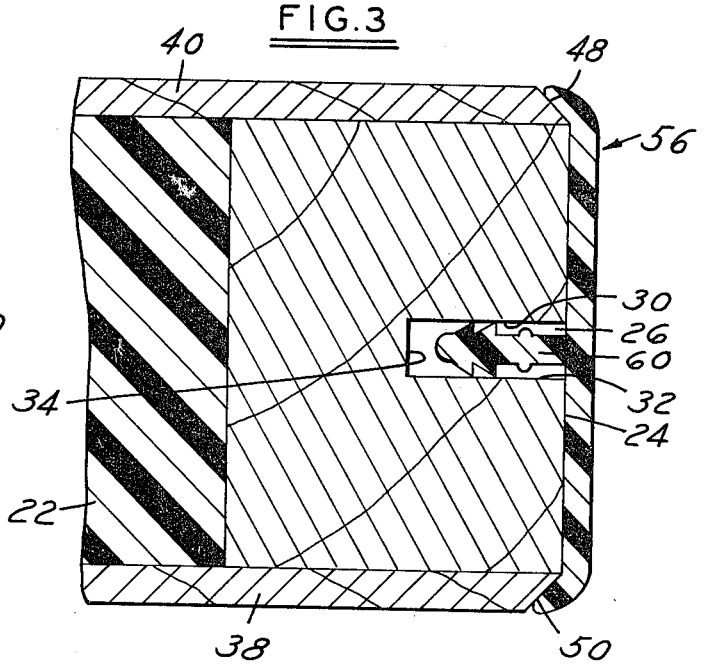
FIG. 3 is an enlarged fragmentary sectional view through one of the vertical stiles of the door taken on the line 3—3 of FIG. 1.

The wood door 10 shown in FIG. 1 is primarily adapted for use as an exterior door in a building, dwelling or the like. The door 10 comprises a rectangular shaped wood frame 12 comprising a pair of vertical stiles 14 and 16 which are joined together at their upper and lower panels by an upper horizontal rail 18 and by a lower horizontal rail 20 respectively. The stiles and rails are made from wood, with the ends thereof being mitred or cut at 45° so as to form abutment surfaces for attachment of the rails to the stiles by means of staples or other fasteners. The interior space of the frame 12 may be filled with a solid core or in some cases with a hollow core. The solid core is preferably made from a plastic foam material 22 which is well known in the art. In certain exterior doors the fill material may take the form of a series of wood blocks glued together or a series of wood blocks carried by and glued to cardboard and located entirely within the hollow frame 12. In the event the door 10 is used as an exterior door, a hollow core may be used such as an expanded wood type core or cardboard type core as is well known in the art.

The outer surface 24 of each rail 18, 20 and stile 14, 16 is provided with a centrally located groove 26. The groove 26 extends the entire length of the rail or stile. Groove 26 has a pair of parallel side walls or surfaces 30, 32 connected by an inner surface 34. Each groove 26 opens outwardly away from the plastic core 22. In effect, each groove 26 has the ends thereof aligned with and connected to the corresponding grooves 26 in the adjacent rails or stiles resulting in an endless groove around the periphery of the door 10.

The door 10 further includes a pair of generally rectangular exterior panels or skins 38, 40. The panels 38, 40 are made from plywood or composition board or other suitable material as is well known in the art. Each wood panel 38, 40 is of rectangular configuration and has a bevel surface 44 along the top edge thereof, a bevel surface 46 along the bottom edge thereof and a pair of beveled surfaces 48 and 50 along the side edges thereof. Each panel 38, 40 is of generally identical construction each having a bevel surface along the entire periphery thereof located on a predetermined angle. Each bevel surface has generally the same angle and is recommended at an angle of 45°.

The opposite vertical faces of the frame 12 and core 22 are covered by the panels 38, 40 which are glued or adhesively secured to the faces 24 of the frame 12 to prevent separation thereof.

Figure 2:
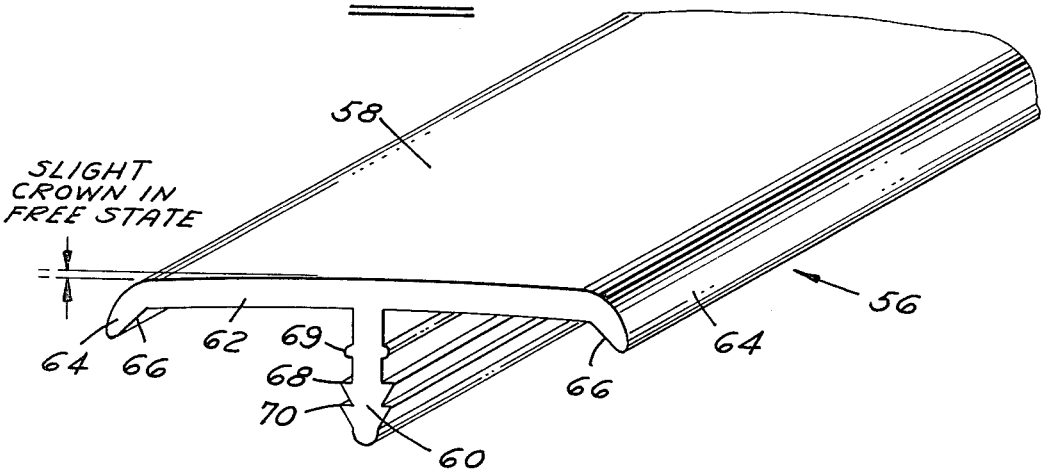
FIG. 2 is a fragmentary perspective view of a closure molding strip used along the top rail and stiles of the door and illustrating the molding strip as having a crown or curve in its free state.
Figure 4:
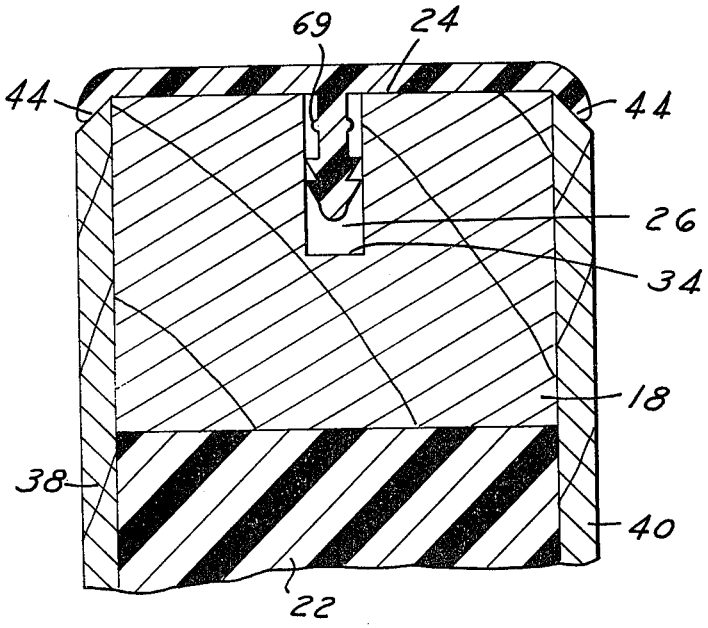
FIG. 4 is an enlarged fragmentary sectional view through the top rail of the door taken on the line 4—4 of FIG. 1.

A closure molding 56 is provided for each of the outer surfaces 24 of the rails and stiles. Each closure molding 56 comprises a generally elongated rigid strip formed of plastic material, as an example, polyvinyl chloride. The strip 56 used on the top rail 18 and on the stiles 14, 16 are each of identical cross-section as shown in FIG. 2. The strip 56 in an unstressed or free state is provided with a slight curve or a crown which is removed when the molding strip is applied to the frame 12.

Each strip 56 has a generally flat web or base 58 and an elongated ledge or rib 60 on the inner surface 62 of the web 58. The ledge 60 is located midway between the outer longitudinal edges 64.

The outer edges 64 of each web 58 are inclined or slanted. The inner edge surfaces 66 on the longitudinal edges 64 are located on an angle or slope equal to the angle of the corresponding bevel surfaces provided on the panels 38, 40. In the example shown each of the angles provided on the bevel and inclined surfaces is 45°.

The ledges or ribs are each provided throughout its length with symmetrical pairs of ridges or barbs 68, 70 which tend to bite into the wood at the surfaces 30, 32 of the groove 26 in order to retain the strip 56 on the upper rail 18 or stiles 14, 16. When the strip 56 is applied to the frame the slight crown or curve in the web 58 is removed so as to force the ridges 68, 70 outwardly to better grip the wood rail or stile. Each groove 26 has a depth greater than the length of the corresponding ledge 60. Each ledge 60 also has a pair of symmetrical formations 69.

The molding strip provided in the bottom or lower rail 20 is similar to strip 56 and is designated by the number 74. The lower molding strip 74 has an elongated web 78, which may be slightly curved in its free state like web 58 shown in FIG. 2, which extends in one direction and a laterally extending integral ledge or rib 80 on the inner surface of web 78. The ledge 80 has symmetrical pairs of barbs or ridges 68',70' and a pair of symmetrical formations 69' like molding strip 56.

The molding strip 74 further is provided with slanted inner surfaces 66' on the longitudinally extending edges 64' of the web 78.

Figure 5:
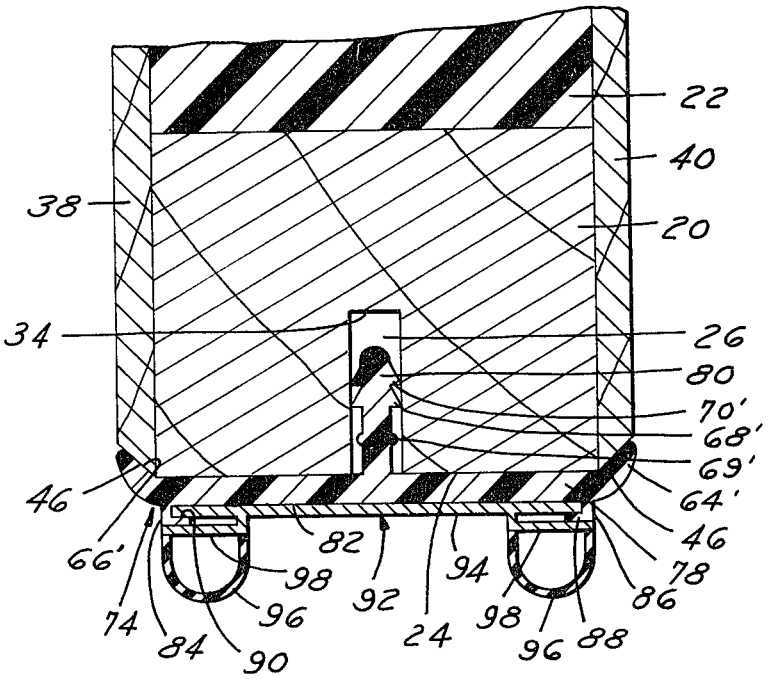
FIG. 5 is an enlarged sectional view through the bottom rail of the door taken along the line 5—5 of FIG. 1.

The outer surface 82 of web 78 (FIG. 5) is provided with a pair of inwardly turned generally L-shaped retaining flanges 84 which are located adjacent to the longitudinal edges 64' and are parallel thereto.

Each L-shaped flange 84 has a first leg 86 perpendicular to the web 78 and second leg 88 which is spaced from and is parallel to the web 78. Thus the L-shaped retaining flanges 84 form a pair of longitudinally extending grooves 90.

A removable or detachable stepped door sweep assembly 92 is slidably carried by the grooves 90. The assembly 92 has a generally flat plate 94 with longitudinal edges which are received in the grooves 90. The assembly 92 further includes a pair of elongated compressible hollow tubes or elements 96 appropriately secured to extensions or formations 98 depending from the plate 94. The tubes 96 extend the entire length of the plate 94 and the corresponding rail 20. The tubes are designed for sealing engagement with a cooperating door sill not shown. After the door sweep assembly 92 has worn, it may be removed from the molding strip 74 and replaced with another door sweep assembly 92.

When the four strips 56 and 74 are applied to the rails and stiles, the ledges 60 and 80 fit tightly in the grooves 26, with the inclined surfaces of the edges of the webs abutting the bevel surfaces of the panels 38, 40 to provide at each side of the frame 12 an inwardly directed positive force around the entire periphery thereof which opposes separation of the panels 38, 40 from the frame 12 even if delamination of the panels from the frame should occur.

Thus the outer edges 64 and 66' of the molding strips 56 and 74 respectively form elongated locking lips or means which squeeze or pinch the outer bevel edges of the panels 38, 40 thus resulting in positive pressure points or areas around the entire periphery of the frame.

The molding strips 56, 74 are normally cut on a 45° angle to form mitered and abutting surfaces. The strips form an endless seal or band around the frame 12 effective to assist in preventing moisture from entering the interior of the door 10 but more importantly also assisting in preventing separation of the panels 38, 40 from the frame 12 in the event moisture should cause delamination of the panels.

What is claimed is:

1. A wood door primarily adapted for use as an exterior door in a building, dwelling or the like, having a rectangular shaped wood frame having a pair of vertical stiles joined together at their upper ends by a horizontal top rail and lower ends by a horizontal bottom rail, said stiles and said rails each having an outer surface and a groove extending the full length of said outer surfaces, a core of fill material located in said frame in the space between said stiles and said rails and occupying said space, the opposite vertical faces of said frame being covered by exterior wood panels which are adhesively secured to said faces of said frame, and each of the upper, lower and side edges of each of said panels being provided with a bevel surface having a predetermined angle and each bevel surface having generally the same angle, comprising:

a closure molding for each of said outer surfaces of said rails and said stiles, each closure molding comprising a generally elongated rigid strip formed of resilient material;

said closure molding strip in an unstressed or free state is provided with a crown or a slight curve which is removed when the molding strip is applied to said frame;

said strip having a generally flat elongated web and a laterally extending elongated ledge on the inner surface of the web which is perpendicular thereto;

with the inner surface on each of the outer edges of each web being inclined at an angle which is equal to the angle of the corresponding bevel surface provided on the adjacent panel;

said ledges fitting tightly into said grooves, with said inclined surfaces of said outer edges of said webs abutting said bevel surfaces of said panels to provide at each side of said frame an inwardly directed positive force around the entire periphery thereof which opposes delamination of said panels from said frame;

said molding strips provided on said top rail on both of said stiles are of identical cross-section;

said molding strip secured to said bottom rail is provided with a pair of inwardly turned generally L-shaped retaining flanges;

said L-shaped retaining flanges forming a pair of longitudinally extending grooves which receive the edges of a removable plate;

said removable plate having a pair of compressible tubular elements adapted for sealing engagement with a cooperating door sill, and said removable plate is formed from a generally rigid plastic material.

* * * * *